United States Patent [19]

Odeh et al.

[11] 4,392,530

[45] Jul. 12, 1983

[54] METHOD OF IMPROVED OIL RECOVERY BY SIMULTANEOUS INJECTION OF STEAM AND WATER

[75] Inventors: Aziz S. Odeh, Dallas; Billy J. Dotson, Grand Prairie, both of Tex.

[73] Assignee: Mobil Oil Corporation, New York, N.Y.

[21] Appl. No.: 259,329

[22] Filed: Apr. 30, 1981

[51] Int. Cl.[3] ..... E21B 43/24

[52] U.S. Cl. ..... 166/269; 166/272

[58] Field of Search ..... 166/269, 272

[56] References Cited

U.S. PATENT DOCUMENTS 4,166,504 9/1979 Brown et al. ..... 166/272

4,274,487 6/1981 Hollingsworth et al. ..... 166/251 X

*Primary Examiner*—Stephen J. Novosad

*Assistant Examiner*—George A. Suchfield

*Attorney, Agent, or Firm*—Charles A. Huggett; James F. Powers, Jr.; Lawrence O. Miller

[57] ABSTRACT

A method for recovering heavy oil from a subterranean, permeable, heavy oil-containing formation comprising injecting steam into the lower portion of the formation, injecting a controlled amount of unheated water into the upper portion of the formation and displacing the oil through the formation toward a production well where the oil is produced. The steam injection releases heat (BTU) to the heavy oil and formation reducing the viscosity of the oil and increasing its mobility for recovery. The sequence of injection of the water and steam is designed to yield the maximum oil recovery per BTU injected by increasing the volume of the formation subjected to heating and increasing the vertical sweep.

1 Claim, 1 Drawing Figure

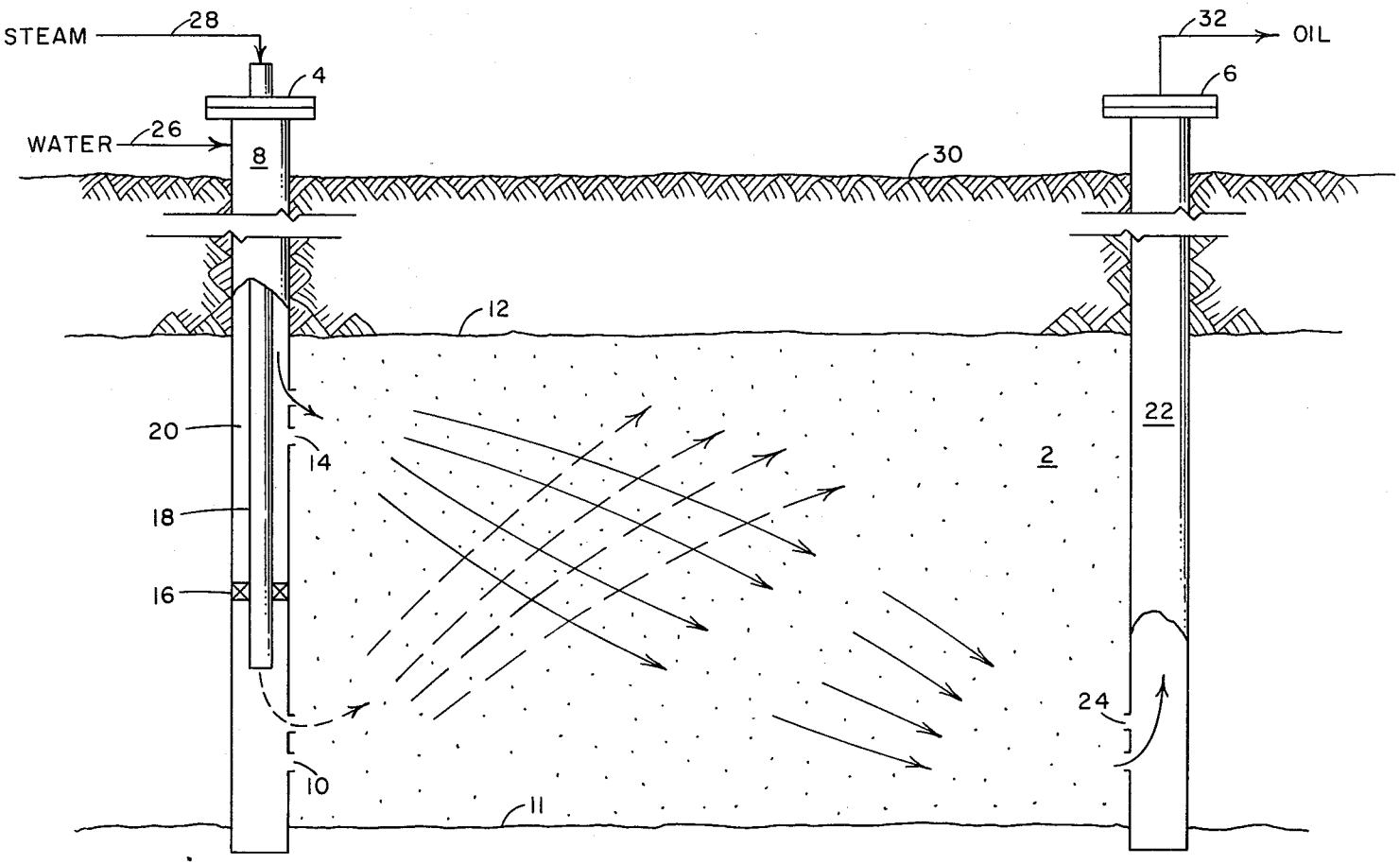
OIL
32
6
22
24
2
30
12
11
4
14
10
8
28
26
20
18
16
STEAM
WATER

METHOD OF IMPROVED OIL RECOVERY BY SIMULTANEOUS INJECTION OF STEAM AND WATER

BACKGROUND OF THE INVENTION

1. Field of the Invention

This invention relates to a thermal method for the recovery of oil, especially viscous or heavy oil, from a subterranean, permeable, heavy oil-containing formation in which unheated water is injected into the upper portion of the formation via an injection well, steam is injected into the lower portion of the formation via the aforementioned injection well or one closely spaced therefrom, and these fluids drive the oil toward a production well where the oil is recovered.

2. Background of Prior Art

The injection of steam to recover oil from heavy oil formations is an accepted method in the industry. Past experiments and field performance have shown the improved displacement efficiency of heavy oils by reduction in viscosity of the oil by a heated displacing phase. Displacement of oil increases with increasing temperature.

Steam is considerably lighter than the oil and water present in the formation and thus, because of gravity segregation, it tends to rise to the top of the formation when vertical communication exists. Consequently, the injected steam channels through the top of the formation to the producing well overriding a major portion of the formation and contacting only a small fraction of the formation oil. This behavior results in an inefficient oil recovery and low vertical sweep efficiency.

U.S. Pat. No. 4,088,188 to Widmyer, discloses a method for recovering viscous petroleum from a subterranean, permeable, porous, viscous petroleum-containing formation, by penetrating the formation with an injection well and a production well, separating saturated steam into two components, one of which is substantially all in the vapor phase and the other of which is substantially all in the liquid phase, and then injecting the vapor phase fraction of the steam at or near the bottom of the petroleum formation and injecting the liquid fraction (hot water) at or near the top of the formation. The hot water and steam drive the oil which is reduced in viscosity by the heat content of the steam through the formation toward the production well where the oil is recovered. This process increases the portion of the vertical thickness of the formation contacted by the displacement fluids. In this process, the amount of water that can be injected into the upper portion of the formation is limited to that available from the wet steam generated on the surface. The amount of water present will vary depending upon the quality of the steam which is defined by specifying the weight fraction which is in the vapor phase. Thus, 80 percent quality steam means that 80 percent of the steam on the basis of weight is vapor with the remaining 20 percent being liquid phase. Therefore, the amount of water available for heat scavenging and subsequent water drive is limited.

Another source of inefficiency in the Widmyer process lies in the fact that the water injected into the formation is limited to hot water. In using steam injection or steam flooding, a large quantity of residual heat is left behind within the formation and unless this heat can be utilized the thermal efficiency of the process is low. The injection of hot water into the formation will scavenge less of this residual heat than the injection of unheated water or water at ambient temperature. Also, hot water has a lower viscosity than unheated water and will therefore produce somewhat less mobility control in the steamed zone.

SUMMARY OF THE INVENTION

According to the present invention, we have found an improved method for recovering oil, especially viscous or heavy oil, from a subterranean, permeable, heavy oil-containing formation wherein unheated water at a controlled rate is injected at or near the upper portion of the formation and steam is injected at or near the lower portion of the formation. The steam heats the oil thereby reducing its viscosity and enabling both fluids to drive the oil through the formation toward a production well where the oil is recovered. The water, with a higher density, tends to segregate to the bottom of the formation because of gravitational forces, whereas the low density steam tends to segregate to the top. In addition to the desirable heat exchange, an additional benefit in flow behavior results. The water tends to fill steam swept channels thus impeding the flow of steam and diverting it to previously unswept paths resulting in higher vertical sweep efficiency. The water passing through the steam heated formation scavenges heat and becomes a hot water drive displacing oil from lower regions, not contacted by steam, which further improves recovery efficiency per BTU of heat injected.

BRIEF DESCRIPTION OF THE DRAWING

The drawing is a view in cross-section of an injection well and a production well penetrating a subterranean, permeable, heavy oil-containing formation illustrating the invention.

DESCRIPTION OF THE PREFERRED EMBODIMENTS

The invention relates to the thermal recovery of heavy oil from subterranean, permeable, heavy oil-containing formations by injecting steam and unheated water into the formation in a prescribed manner. The steam injection releases heat (BTU) to the formation and the oil leading to a reduction in the viscosity of the oil and facilitating its displacement from the formation. The sequence of injection is designed to yield the maximum oil recovery per BTU injected by increasing the volume of the formation subjected to heating and increasing the vertical sweep. The desired recovery efficiency per BTU of heat injected is achieved, in effect, by concurrently and separately injecting steam at or near the bottom of the formation and unheated water at or near the top of the formation. The water, with a higher density, tends to segregate to the bottom of the formation because of gravitational forces, whereas the low density steam tends to segregate to the top. In addition to the desirable heat exchange an additional benefit in flow behavior results. The water tends to fill steam swept channels thus impeding the flow of steam and diverting it to previously unswept paths resulting in higher vertical sweep efficiency. The unheated water passing through the steam heated formation scavenges heat and becomes a hot water drive displacing oil from the lower regions, not contacted by steam, which further improves recovery efficiency per BTU of heat injected. By the manner of operation, a greater portion of the formation is contacted by the heated displacing phase thereby substantially increasing the recovery of oil from the formation.

The drawing shows a subterranean, permeable, heavy oil-containing formation 2 penetrated by an injection well 4 and a remotely located production well 6. The injection well has casing 8 set through the oil-bearing formation 2 with the casing cemented at least through the oil-bearing formation 2. The casing 8 is perforated or opened into the formation 2 with lower perforations 10 adjacent or near the bottom portion 11 of the formation and upper perforations 14 adjacent or near the upper portion 12 of the formation. Perforations 10 are separated from perforations 14 by a conventional injection packer 16 positioned in the casing 8. Injecting tubing 18 is installed in the injection well from the surface 30 through the packer 16 to a location adjacent the lower perforations 10. The injection well is thereby equipped for separate injection of fluids through the annulus 20 formed between the casing 8 and the tubing 18 and outwardly through the upper perforations 14 and into the formation 2 and through the tubing 18, the lower perforations 10 and into the lower portion of the formation.

The production well 6 has casing 22 set through and cemented at least through the formation 2 with perforations 24 opening the casing 22 into fluid communication with the formation adjacent the lower portion 11 of the formation.

In the operation of the thermal recovery method of the preferred embodiment of the invention, steam is injected into the injection well 4 through line 28, passing downwardly through injection tubing 18, outwardly through the lower perforations 10 and into the lower portion of the formation 2. Concurrently or in sequence, unheated water is injected at a controlled rate through the injection well 4 through line 26, passing downwardly through annulus 20, outwardly through the upper perforations 14 and into the upper portion of the formation 2. The unheated water, with a higher density, tends to segregate to the bottom of the formation 2 because of gravitational forces, whereas the low density steam tends to segregate to the top. The water passing through the steam heated formation scavenges heat and becomes a hot water drive displacing oil from lower regions of the formation toward production well 6. The steam which moves horizontally through the upper portion of the formation, heats the oil reducing its viscosity and drives the oil toward production well 6. The displaced oil enters production well 6 through the lower perforations 24 and is produced through casing 22 and recovered at the surface 30 via line 32.

The amount of steam and unheated water injected into the formation is controlled to obtain the optimum recovery of oil per BTU of heat injected and to obtain the highest vertical sweep efficiency.

In accordance with another embodiment of the invention, slugs of steam and unheated water may be injected into the formation either concurrently, in sequence, or in combination of in sequence and concurrently wherein the steam is injected at or near the lower portion of the formation and unheated water injected at or near the upper portion of the formation.

Also, in another embodiment of the invention, two or more closely spaced injection wells may be used to inject steam and unheated water into the preferred portions of the formation. For example, in the case of two closely spaced injection wells, steam is injected into the lower portion of the formation through one injection well and unheated water injected into the upper portion of the formation through the other injection well. The steam and unheated water may be injected concurrently in a continuous flow or with periodic termination of either fluid. The selection of the number of injection wells and the sequence of injecting unheated water and steam will be dictated by preferred engineering practices.

The present invention may be carried out utilizing any suitable injection and production system. The injection and production systems may comprise one or more wells extending from the surface of the earth into the oil-bearing formation. Such injection and production wells may be located and spaced from one another in any desired pattern. For example, a line drive pattern may be utilized in which a plurality of injection wells are arranged in a more or less straight line toward a plurality of production wells in a more or less straight line parallel to a line intersecting the plurality of injection wells. In addition, a circular drive pattern may be used in which the injection system comprises a central injection well and the production system comprises a plurality of production wells about the injection well in a ring pattern such as a 5-spot or 7-spot well pattern.

We claim:

1. A method for recovering heavy oil from a subterranean permeable, heavy oil-containing formation penetrated by at least one injection well and at least one spaced apart production well, said injection well containing at least two separate flow paths, the first path in fluid communication with the upper portion of the formation and the second path in fluid communication with the lower portion of the formation, and said production well in fluid communication with the lower portion of the formation, comprising:

a. injecting steam into the lower portion of the formation via the second flow path of the injection well, said steam passing through the formation, displacing oil and reducing the oil's viscosity;

b. injecting unheated water into the upper portion of the formation via the first flow path of the injection well subsequent to the period of steam injection into the lower portion of the formation and prior to steam breakthrough to impede the upward flow of steam and divert it to previously unswept paths resulting in a higher vertical sweep efficiency to scavenge heat from the steam and become a hot water drive displacing oil reduced in viscosity from lower regions in the formation; and c. recovering oil from the lower portion of the formation via said production well.

* * * * *